United States Patent [19]

Soltani et al.

[11] Patent Number: 4,855,879

[45] Date of Patent: Aug. 8, 1989

[54] HIGH-LUMINANCE RADIOLUMINESCENT LAMP

[75] Inventors: Peter K. Soltani, Olney; Charles Y. Wrigley, Ijamsville, both of Md.; George M. Storti, Washington, D.C.

[73] Assignee: Quantex Corporation, Rockville, Md.

[21] Appl. No.: 229,567

[22] Filed: Aug. 5, 1988

[51] Int. Cl.[4] ..... F21V 9/16

[52] U.S. Cl. ..... 362/84; 362/31; 362/209; 362/266; 313/54

[58] Field of Search ..... 362/31, 32, 34, 209, 362/266, 84; 40/545; 313/54

[56] References Cited

U.S. PATENT DOCUMENTS

| | | | |
|---|---|---|---|
| 3,176,132 | 3/1965 | Müller | 313/54 XR |
| 4,285,029 | 8/1981 | McCoy | 362/84 |
| 4,546,417 | 10/1985 | Watts | 362/84 |

*Primary Examiner*—Stephen F. Husar

*Attorney, Agent, or Firm*—Ostrolenk, Faber, Gerb & Soffen

[57] ABSTRACT

In a preferred embodiment, a radioluminescent lamp having a glass face plate with a plurality of parallel planer light guides, each preferably having a transparent glass, sapphire or quartz base member, disposed perpendicularly with respect to the glass face plate and coated on both sides with a thin film of radioluminescent phosphor material. The plates are mounted in a sealed envelope filled with tritium gas, the radioactive decay of the tritium causing the phosphor to luminesce. The phosphor material and all but one of the edges of each light guide are overcoated with a reflective material, such as aluminum, to guide the generated light to a single edge of the light guide, which edge is adjacent the glass face plate. The phosphor is preferably a calcium sulfide-based material forming a continuous, binder-free layer on the transparent base member. The resulting structure has a high phosphor-surface-area to tritium-gas-volume ratio and directional light guiding, yielding a substantially higher output light density than conventional radioluminescent lamps.

15 Claims, 1 Drawing Sheet

2
2
10
12
12
12
12
14
16
18
19
20
22
30
32
34
34
36
Bw

HIGH-LUMINANCE RADIOLUMINESCENT LAMP

CROSS-REFERENCE TO RELATED APPLICATIONS

The present application uses phosphor materials, the preparation and deposition of which materials in thin films on substrates is described in co-pending U.S. patent application, Ser. No. 213,347 pending filed June 30, 1988, titled "Thin Film Inorganic Scintillator and Method of Making Same", which is hereby made a part hereof by reference. Both applications are assigned to a common assignee.

BACKGROUND OF THE INVENTION

Field of the Invention

This invention relates to radioluminescent lamps generally and, more particularly, to such lamps having high light output.

Description of the Prior Art

Radioluminescent (RL) lamps have been an attractive light source alternative to electric lamps, due to their ability to operate for many years with no need for external power or maintenance. Such lamps are in commercial use as safety lights (e.g., "exit" signs) and also are used in remote lighting, such as for airport runway lights in areas far removed from electric power sources. An example of a safety sign lighted by RL lamps is described in U.S. Pat. No. 4,383,382, issued May 17, 1983, to Hegarty.

The use of such lamps, even in the aforementioned applications, has been severely limited, due to the very low level of light output which frequently makes them nearly useless under conditions other than those approaching total darkness. For example, the brightest known RL lamps have brightnesses on the order of 0.1 to 1 percent that of typical indoor artificial lighting.

Heretofore known methods of producing RL lamps consist of depositing a layer of phosphor powder (usually zinc sulfide activated with copper) on the inside surface of a hollow glass tube which is evacuated and back-filled with a beta (negative electron) emitting radioisotope, namely, tritium gas. The beta emissions from the decay of the tritium impinge on the phosphor powder producing luminescence of green wavelength.

Good quality zinc sulfide phosphors have been shown to possess intrinsic energy efficiencies of up to 24 percent, i.e., 24 percent of the incident beta particle energy is converted into photon energy. However, the overall energy efficiency of a phosphor-tube system is considerably lower than 24 percent. The efficiency reduction occurs due to two factors: Firstly, in the powder on the inside tube surface, the photons produced undergo both scattering and absorption before they finally escape from the powder and then the tube, especially if the powder layer is thick. Secondly, reducing the thickness of the powder layer, even though such an approach improves output per absorbed beta particle, it decreases the beta particle absorption, as well as making it difficult to apply a uniform adherent stable layer. Therefore, even thickness-optimized powder layers are found to exhibit overall energy efficiencies which are usually no better than 6 percent.

Another difficulty with powder lamps is the need to use a binder to physically hold the particles together and to the substrate. Any such binder will absorb some of the beta energy and eventually darken due to radiation damage, resulting in substantial decreases in brightness and lamp life.

A further limitation of conventional RL lamps is in their physical construction in that heretofore the ratio of phosphor-surface-area to tritium-gas-volume has been limited.

OBJECTS AND SUMMARY OF THE INVENTION

A primary object of the present invention is to provide an RL lamp having a substantially improved light output.

A more specific object of the present invention is to provide an RL lamp having a high phosphor-surface-area to tritium-gas-volume ratio.

Another object of the invention is to provide an RL lamp employing a new radioluminescent phosphor material and application technique.

The above and other objects of the present invention which will become more apparent as the description proceeds, are realized by providing, in a preferred embodiment, an RL lamp having a glass enclosure and face plate, said enclosure containing therein a plurality of parallel planar light guides, each of which is preferably formed of a transparent base member, such as glass or quartz, disposed perpendicularly with respect to the glass face plate; each planar light guide being coated on both major faces with a vapor deposited transparent thin film of phosphor material. The plates are mounted in a sealed body filled with tritium gas, the radioactive decay of the tritium causing the phosphor to luminesce. The phosphor material and three of the edges of each light guide are overcoated with a reflective material, such as aluminum, to guide the generated light to a single edge of the light guide, which edge may be antireflection coated to pass the maximum amount of light through to the glass face plate. The resulting structure has a high phosphor-surface-area to tritium-gas-volume ratio and concentrates the light generated by radioluminescence to the faceplate.

The phosphor is preferably a calcium sulfide-based material which has been vapor deposited to form a continuous, transparent and binder-free layer on the base member. An example of a preferred phosphor is described in co-pending U.S. patent application, Ser. No. 213,347, filed June 30, 1988, where there is described a unique phosphor material consisting of calcium sulfide activated with rare earth compounds which yields a high efficiency phosphor especially suitable for use in RL lamps, among other applications. The co-pending application also describes methods of preparing the phosphor and vapor depositing it in a thin film on a suitable substrate without the use of any binders or organic materials. Briefly: The phosphor material having a base material of calcium sulfide is first formed in bulk with cerium sulfide, cerium oxide, cerium fluoride, cerium chloride, or elemental cerium, and lithium fluoride. The material is then applied to a suitable substrate of, for example, quartz, sapphire, or most glasses using one of a number of thin film techniques, such as physical vapor deposition by electron-beam evaporation. Either following or contemporaneously with the deposition, at least the phosphor material is subjected to a high temperature for a sufficient period of time to effect activation and recrystallization, such that the material acquires luminescent characteristics and becomes transparent. The resulting film is desirably continuous and thin, thus avoiding the major limitations of powder phosphors layers. There are no organic binders which undergo radiation damage, thereby shortening the life of the lamp. The CaS based phosphor of the present invention exhibits very high energy conversion efficiency and a high degree of radiation hardness.

The unique lamp structure, in conjunction with the phosphor embodiment of the co-pending application, provides a substantially higher output light density than conventional RL lamps.

DESCRIPTION OF THE DRAWING

The above and other features of the present invention will be more readily understood when the following detailed description is considered in conjunction with the accompanying drawing wherein like characters represent like parts throughout the several views and in which.

DETAILED DESCRIPTION OF THE PREFERRED EMBODIMENT

Figures 1, 2, 3:
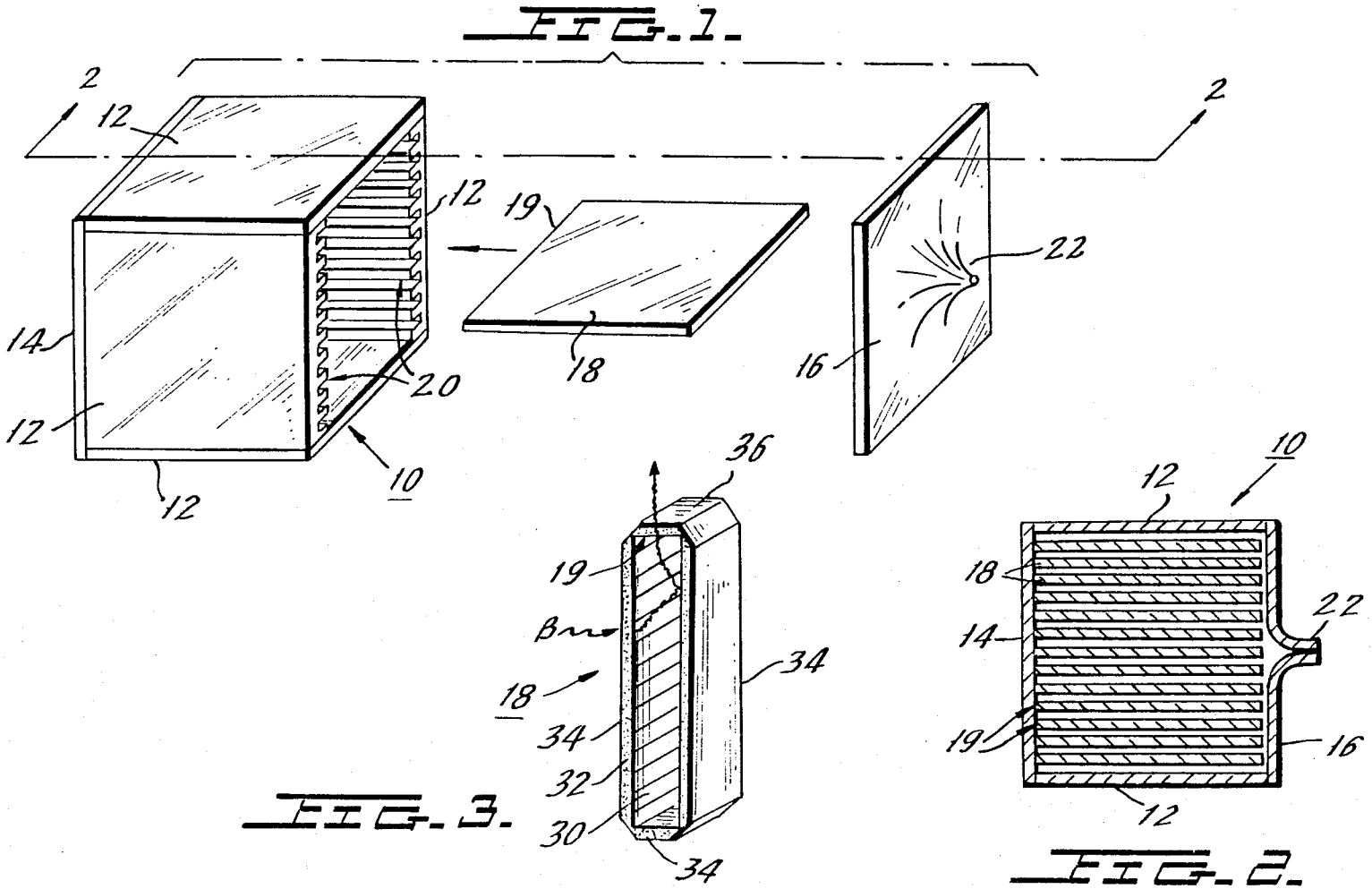
FIG. 1 is an exploded perspective view of a portion of an RL lamp constructed according to the present invention.
FIG. 2 is a cross-sectional view of the assembled lamp, taken along line 2—2 of FIG. 1.
FIG. 3 is a perspective view, in cross-section, of a light guide for use in the lamp.

FIGS. 1 and 2 show an RL lamp, generally indicated by the reference numeral 10, constructed according to the present invention, having sides 12, a face plate 14, and a back 16 which are joined to form a gas-tight containment envelope. A plurality of spaced apart, parallel, planar light guides, as at 18, are disposed orthogonally to the plane of face plate 14 with one edge 19 of each light guide in juxtaposition with the inner surface of face plate 14. Grooves, as at 20, formed in a pair of oppositely disposed sides 12 are dimensioned to snugly hold light guides 18 in spaced apart relationship and in juxtaposition with face plate 14. Back 16 includes a sealed tip-off tube 22 which has been used to evacuate lamp 10, after which evacuation the lamp was filled with radioactive gas, such as tritium, and the opening sealed.

Reference to FIG. 3 should be had for a clearer understanding of the structure of light guides 18. Each light guide 18 includes a substrate, or base member, 30, each major face of which base member has a vapor deposited thin film of phosphor material 32. Phosphor material 32, the end edges (not shown) of base member 30, and the bottom edge of the base member are covered with a reflective overlayer 34. The top edge of base member 30 (the edge juxtaposed with face plate 14) is preferably coated with a layer of appropriate thickness of antireflective material 36 to reduce light losses due to internal reflection and to assure optimum optical coupling from the interior of 18 to face plate 14.

In operation, beta particle "$\beta$" emitted by the decay of the tritium gas penetrates reflective layer 34 and strikes phosphor material 32 which responds by emitting photons of visible light. The visible light is guided through base member 30 by reflection of the light off the reflective coating 34 until it is "piped" out the top edge 19 of light guide 18 and thus is emitted from RL lamp 10 through face plate 14. Since the preferred phosphor material is transparent, the emitted light is easily reflected along light guides 18.

Lamp 10 is preferably constructed of Pyrex, although any suitable transparent material which is impervious to the radioactive gas may be employed for face plate 14, while the sides 12 and back 16 need not be transparent. Base member 30 is preferably sapphire, glass or quartz. Phosphor material 32 is preferably the novel material described in co-pending U.S. patent application, Ser. No. 213,347, filed June 30, 1988, deposited by thin film techniques also described therein in a layer on the order of about 4 microns thick. Reflective overlayer 34 is preferably aluminum or other low atomic number, high reflectance material, having a thickness sufficient for good optical reflectance but yet thin enough for low beta absorption, being on the order of about 500 Angstroms. Antireflective layer 36 may be magnesium fluoride. The radioactive gas is preferably tritium gas at or around atmospheric pressure.

Dimensions and spacing of light guides 18 are critical to assure optimum performance of RL lamp 10. The optimum spacing between adjacent light guides 18 is on the order of about 3 millimeters when the tritium gas is at one atmosphere pressure. It is calculated that when so dimensioned and spaced, a lamp using the novel phosphor embodiment described above will produce a light output at the exit face which is a large multiple of the prior art tube structures.

While base members 30 have been described a being planar to produce an optimum density of phosphor surfaces in RL lamp 10, it will be understood that base members having other shapes, such as cylinders, may be employed as well.

Although various specific details have been discussed herein, it is to be understood that these are for illustrative purposes only. Various modifications and adaptations will be apparent to those skilled in the art. Accordingly, the scope of the present invention should be determined by reference to the claims appended hereto.

What is claimed is:

1. A radioluminescent lamp, comprising:

(a) a containment envelope filled with radioactive gas and having a face plate; and (b) a plurality of light guides disposed within said containment envelope, each said light guide being optically coupled to said face plate; wherein each of said light guides comprises:

(a) a substrate;

(b) a thin vapor-deposited layer of phosphor material disposed on said substrate; and (c) a reflective overlayer disposed so as to guide light produced by said phosphor material through said substrate to said face plate.

2. The radioluminescent lamp of claim 1, wherein said containment envelope is filled with a radioactive gas.

3. The radioluminescent lamp of claim 2 wherein said radioactive gas is tritium.

4. A radioluminescent lamp comprising:

(a) a containment envelope filled with radioactive gas and having a face plate; and (b) a plurality of light guides disposed within said containment envelope, each said light guide being optically coupled to said face plate;

wherein each of said light guides comprises:

(a) a planar substrate with a first edge of said substrate adjacent said face plate;

(b) a layer of phosphor material disposed on at least each major face of said substrate; and (c) a reflective a material disposed over each said layer of phosphor material and over the remaining edges of said substrate.

5. The radioluminescent lamp of claim 4, further comprising an antireflective coating on said first edge of said substrate.

6. The radioluminescent lamp of claim 4, wherein said substrate is a material selected from the group consisting of quartz, glasses and sapphire.

7. The radioluminescent lamp of claim 4, wherein said phosphor material comprises calcium sulfide activated with rare earth compounds.

8. The radioluminescent lamp of claim 4, wherein said reflective material comprises aluminum or other low atomic number, high reflectance material.

9. The radioluminescent lamp of claim 6, wherein the thickness of said substrate is on the order of about 0.5

10. The radioluminescent lamp of claim 7, wherein the thickness of said phosphor material is on the order of about 4 microns.

11. The radioluminescent lamp of claim 8, wherein the thickness of said aluminum layer is on the order of about 500 Angstroms.

12. The radioluminescent lamp of claim 4, wherein said containment envelope is generally rectilinear.

13. The radioluminescent lamp of claim 12, further comprising:

(a) four generally rectangular sides adjacent said face plate;

(b) a generally rectangular back adjacent said four sides; and (c) a plurality of inward facing grooves formed in two oppositely disposed sides, each corresponding pair of said grooves sized to hold therein one of said light guides.

14. The radioluminescent lamp of claim 12, wherein said light guides are parallelly disposed, with the plane of each said light guide essentially orthogonal to the plane of said face plate.

15. The radioluminescent lamp of claim 14, wherein each said light guide is spaced apart from each adjacent said light guide a distance on the order of about 3 millimeters.

* * * * *